US005372483A

United States Patent [19]

Kimura et al.

[11] Patent Number: 5,372,483

[45] Date of Patent: Dec. 13, 1994

[54] AXIAL MULTI-PISTON TYPE COMPRESSOR HAVING ROTARY VALVE FOR INTRODUCING FLUID FROM SUCTION CHAMBER INTO CYLINDER BORES

[75] Inventors: Kazuya Kimura; Hideki Mizutani; Shigeyuki Hidaka, all of Kariya, Japan

[73] Assignee: Kabushiki Kaisha Toyoda Jidoshokki Seisakusho, Aichi, Japan

[21] Appl. No.: 223,431

[22] Filed: Apr. 5, 1994

[30] Foreign Application Priority Data

Apr. 6, 1993 [JP] Japan ..... 5-079774

[51] Int. Cl.[5] ..... F04B 1/12

[52] U.S. Cl. ..... 417/269; 417/439; 91/480; 91/499; 137/625.11

[58] Field of Search ..... 417/269, 439, 516, 532, 417/539, 222.1, 222.2; 91/436, 480, 484, 499; 137/625.11

[56] References Cited

U.S. PATENT DOCUMENTS 1,367,914 2/1921 Larsson .

5,232,349 8/1993 Kimura et al. ..... 417/269

FOREIGN PATENT DOCUMENTS 350135 3/1922 Germany .

*Primary Examiner*—Richard A. Bertsch

*Assistant Examiner*—Alfred Basichas

*Attorney, Agent, or Firm*—Burgess, Ryan and Wayne

[57] ABSTRACT

An axial multi-piston type compressor includes: a drive shaft; a cylinder block having cylinder bores surrounding the shaft, a central circular space, and respective radial passages for communicating the bores with the space; pistons slidably received in the respective bores, and a housing associated with the block to define a crank chamber. The pistons are successively reciprocated in the bores by a rotation of the shaft so that a suction stroke and a discharge stroke are alternately executed in each bore. A suction rotary valve is rotationally and slidably received in the space to be cooperated with the passages for successively introducing a fluid into the bores subjected to the suction stroke, through the corresponding passages thereof, and for successively closing the passages of the bores subjected to the compression stroke. A leakage of a compressed fluid occurs at openings of the passages of the bores subjected to the compression stroke, and prevails in a clearance between an outer surface of the valve and an inner surface of the space. The valve includes a circular groove passage formed in the outer surface thereof for recovering the leakage to prevent introduction of the leakage into the crank chamber.

4 Claims, 3 Drawing Sheets

AXIAL MULTI-PISTON TYPE COMPRESSOR HAVING ROTARY VALVE FOR INTRODUCING FLUID FROM SUCTION CHAMBER INTO CYLINDER BORES

BACKGROUND OF THE INVENTION

1) Field of the Invention

The present invention relates to an axial multi-piston compressor comprising a drive shaft, a cylinder block having cylinder bores formed therein and surrounding the drive shaft, and a plurality of pistons slidably received in the cylinder bores, respectively, wherein the pistons are successively reciprocated in the cylinder bores by a rotation of the drive shaft so that a suction stroke and a discharge stroke are alternately executed in each of the cylinder bores.

2) Description of the Related Art

Japanese Unexamined Patent Publication (Kokai) No. 59(1984)-145378 discloses a representative of an axial multi-piston type compressor, which may be incorporated in an air-conditioning system used in a vehicle such as an automobile. This compressor comprises: front and rear cylinder blocks axially combined to form a crank chamber therebetween, the combined cylinder blocks having a same number of cylinder bores radially formed therein and arranged with respect to the central axis thereof, the cylinder bores of the front cylinder block being aligned and registered with the cylinder bores of the rear cylinder block, respectively, with the crank chamber intervening therebetween; double-headed pistons slidably received in the pairs of aligned cylinder bores, respectively; front and rear housings fixed to front and rear end faces of the combined cylinder blocks through the intermediary of front and rear valve plate assemblies, respectively, the front and rear housings each forming a suction chamber and a discharge chamber together with the corresponding one of the front and rear valve plate assemblies; a rotatable drive shaft arranged so as to be axially extended through the front housing and the combined cylinder blocks; and a swash plate securely mounted on the drive shaft within the crank chamber and engaging with the double-headed pistons to cause these pistons to be reciprocated in the pairs of aligned cylinder bores, respectively, by the rotation of the swash plate.

The front and rear valve plate assemblies in particular have substantially the same construction, in that each comprises: a disc-like member having sets of suction ports and discharge ports each set being able to communicate with the corresponding one of the cylinder bores of the front or rear cylinder block; an inner valve sheet attached to the inner side surface of the disc-like member and having suction reed valve elements formed integrally therein, each of which is arranged so as to open and close the corresponding suction port of the disc-like member; and an outer valve sheet attached to the outer side surface of the disc-like member and having discharge reed valve elements formed integrally therein, each of which is arranged so as to open and close the corresponding discharge port of the disc-like member. Each of the front and rear valve plate assemblies is also provided with suction openings aligned with passages formed in the front or rear cylinder block, respectively, whereby the suction chambers formed by the front and rear housings are in communication with the crank chamber into which a fluid or refrigerant is introduced from an evaporator of an air-conditioning system, through a suitable inlet port formed in the combined cylinder blocks.

In the compressor as mentioned above, the drive shaft is driven by the engine of a vehicle, such as an automobile, so that the swash plate is rotated within the crank chamber, and the rotational movement of the swash plate causes the double-headed pistons to be reciprocated in the pairs of aligned cylinder bores. When each piston is reciprocated in the aligned cylinder bores, a suction stroke is executed in one of the aligned cylinder bores and a compression stroke is executed in the other cylinder bore. During the suction stroke, the suction reed valve element is opened and the discharge reed valve element is closed, whereby the refrigerant is delivered from the suction chamber to the cylinder bore through the suction port. During the compression stroke, the suction reed valve element concerned is closed and the discharge reed valve element concerned is opened, whereby the delivered refrigerant is compressed and discharged from the cylinder bore into the discharge chamber, through the discharge reed valve element.

In this type compressor, the refrigerant includes a lubricating oil mist, and the movable parts of the compressor are lubricated with the oil mist during the operation. Also, the oil mist appears on the suction and discharge reed valve elements, and serves as a liquid-phase seal when each of the reed valve elements is closed.

When the compression stroke is finished in each of the cylinder bores, the corresponding discharge reed valve element is closed. At this point of time, a small part of the compressed refrigerant is inevitably left in a small space defined between the piston head and the valve plate assembly and in the discharge port formed in the valve plate assembly, and the corresponding suction reed valve element is adhered to the valve seat thereof with the liquid-phase oil. Accordingly, just after the suction stroke is initiated, i.e., just after the corresponding head of the double-headed piston is moved from top dead center toward bottom dead center, the suction reed valve element cannot be immediately opened, i.e., the refrigerant cannot be immediately introduced from the suction chamber into the cylinder bore through the suction reed valve element, because the residual part of the compressed refrigerant has a higher pressure than that of suction chamber, and because the adhesion force and resilient force of the suction reed valve must be overcome before the refrigerant can be introduced from the suction chamber to the cylinder bore through the suction port. Namely, at the beginning of the suction stroke, the residual part of the compressed refrigerant is merely expanded in the cylinder bore, and thus the introduction of the refrigerant from the suction chamber into the cylinder bore cannot take place until a differential between the pressures in the cylinder bore and the suction chamber exceeds a certain level.

Therefore, in the conventional compressor as mentioned above, a practical suction volume of the refrigerant, which can be obtained during the suction stroke, is lower than a theoretical suction volume of the refrigerant due to the residual part of the compressed refrigerant, and thus it is impossible to realize the theoretical performance from the compressor.

Japanese Unexamined Patent Publication (Kokai) No. 5(1993)-71467, corresponding to U.S. Pat. No.

5,232,349 issued on Aug. 3, 1993, discloses an axial multi-piston compressor constituted such that the theoretical suction volume of the refrigerant can be substantially obtained during the suction stroke. In this compressor, the suction reed valves are replaced by a single suction rotary valve slidably disposed in a central circular space formed in the cylinder block and joined to the drive shaft for rotation thereof. Namely, the valve plate assembly is provided with only discharge reed valve elements and the discharge ports, and the suction reed valve elements and the suction ports are eliminated therefrom. The suction rotary valve is provided with an arcuate groove formed in a peripheral surface thereof, and the arcuate groove is in communication with the suction chamber. The suction rotary valve is further provided with a through passage extending diametrically therethrough. On the other hand, the cylinder block is provided with radial passages formed therein, and each of these radial passages is in communication with the corresponding cylinder bore at an end face thereof on which the discharge port is disposed. The inner ends of the radial passages are opened at an inner wall face of the central circular space of the cylinder block in which the suction rotary valve is slidably received.

In the compressor as disclosed in JPP (Kokai) No. 5(1993)-71467 (U.S. Pat. No. 5,232,349), when the suction stroke is executed in each of the cylinder bores, the cylinder bore concerned is communicated with the suction chamber through the radial passage thereof and the arcuate groove of the suction rotary valve, so that the refrigerant is introduced thereinto. During the suction stroke, the communication is maintained between the cylinder bore and the suction chamber due to a given arcuate length of the arcuate groove. When the suction stroke is finished, i.e., when the piston reaches bottom dead center, the communication between the cylinder bore and the suction chamber is cut off. Then, the compression stroke is initiated, so that the piston stroke is moved from bottom dead center toward top dead center. When the compression stroke is finished, i.e., when the piston reaches top dead center, a part of the compressed refrigerant is inevitably left in a small volume of the cylinder bore defined by the piston head and the valve plate assembly, similar to the compressor as disclosed in U.S. Pat. No. 5,232,349. However, just after the compression stroke is finished, i.e., just after the piston is moved from top dead center toward bottom dead center, the cylinder bore concerned is communicated with the diametrically opposed cylinder bore, in which the suction stroke is just finished, through the diametrical through passage formed in the rotary valve, and thus the residual part of the compressed refrigerant escapes from the cylinder bore concerned to the diametrically opposed cylinder bore not governed by the compression stroke. Accordingly, as soon as the cylinder bore concerned is made to communicate with the suction chamber through the radial passage thereof and the arcuate groove of the rotary valve, the refrigerant is introduced from the suction chamber the cylinder bore concerned, due to the escape of the residual part of the compressed refrigerant. As a result, the practical suction volume of the refrigerant, which can be obtained during the suction stroke, is substantially equal to the theoretical suction volume of the refrigerant, and thus it is possible to realize a substantially theoretical performance from the compressor.

Also, the co-pending U.S. application Ser. Nos. 131,449, 132,116, 131,452, and 131,453 discloses an axial multi-piston type compressor having a suction rotary valve which is arranged such that the theoretical suction volume of the refrigerant can be substantially obtained during the suction stroke in the manner similar to the U.S. Pat. No. 5,232,349.

Nevertheless, the above-mentioned compressors having the suction rotary valve involve an issue to be solved. These compressors are constituted such that the crank chamber can be in communication with suction chamber and/or the discharge chamber through a suitable control valve so that the pressure within the crank chamber is variable, whereby the stroke length of the pistons is adjustable. A leakage of the compressed refrigerant is caused at inner openings of the radial passages of the cylinder bores subjected to the compression stroke, and prevails in a clearance between an outer surface of the suction rotary valve and an inner surface of the central circular space in which the suction rotary valve is received. A part of the leakage of refrigerant that prevails in the clearance is introduced into the crank chamber, and thus the pressure within the crank chamber is raised so that the stroke length of the pistons is uncontrollably changed.

SUMMARY OF THE INVENTION

Therefore, an object of the present invention is to provide an axial multi-piston type compressor as mentioned above, which is constituted such that a leakage of the compressed fluid, which is caused at inner openings of the radial passages of the cylinder bores subjected to the compression stroke, can be prevented from being introducing into the crank chamber.

In accordance with the present invention, there is provided an axial multi-piston type compressor comprising: a drive shaft; a cylinder block having cylinder bores formed therein and surrounding the drive shaft, a central circular space formed therein, and respective radial passages formed therein for communicating the cylinder bores with the central circular space; a plurality of pistons slidably received in the respective cylinder bores; a housing member associated with the cylinder block to define a crank chamber therebetween; a conversion means placed in the crank chamber for converting a rotational movement of the drive shaft into a reciprocation of each piston in the corresponding cylinder bore such that a suction stroke and a discharge stroke are alternately executed therein; and a suction rotary valve means rotationally and slidably received in the central circular space of the cylinder block to cooperate with the radial passages of the cylinder block for successively introducing a fluid into the cylinder bores subjected to the suction stroke, through the corresponding radial passages thereof, and for successively closing the radial passages of the cylinder bores subjected to the compression stroke, a leakage of a compressed fluid being caused at openings of the radial passages of the cylinder bores subjected to the compression stroke, and prevailing in a clearance between an outer surface of the suction rotary valve means and an inner surface of the central circular space of the cylinder block, wherein the suction rotary valve means including a circular groove passage means formed in the outer surface of thereof for recovering the leakage of the compressed fluid so as to prevent introduction of the leakage of the compressed fluid into the crank chamber.

Preferably, in the compressor mentioned above, the suction rotary valve means includes a sector-shaped groove formed therein and supplied with a fluid to be compressed, and the sector-shaped groove is arranged so as to be successively communicated with the radial passages of the cylinder bores subjected to the suction stroke, the circular groove passage means being disposed at a peripheral zone of the suction rotary valve between the crank chamber and the sector-shaped groove.

The circular groove passage means may form a closed loop around the outer surface of the suction rotary valve means, and is in communication with the sector-shaped groove through a groove section formed in the outer surface of the suction rotary valve means and extended therebetween. Also, the circular groove passage means may cooperate and communicate with the sector-shaped groove to form a closed loop around the outer surface of the suction rotary valve means.

BRIEF DESCRIPTION OF THE DRAWINGS

The objects and advantages of the present invention will be better understood from the following description, with reference to the accompanying drawings in which.

DESCRIPTION OF THE PREFERRED EMBODIMENTS

Figure 1:
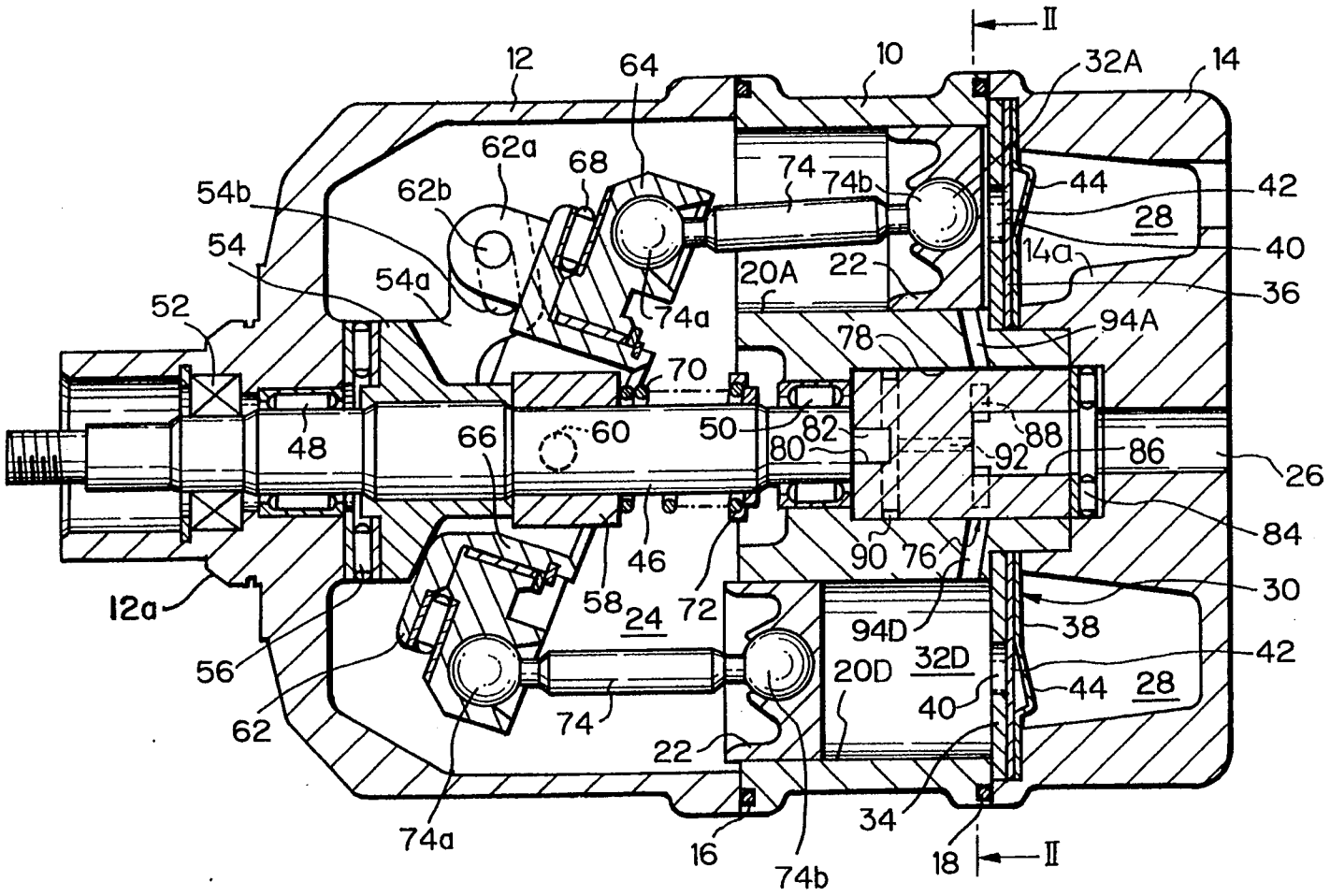
FIG. 1 is a longitudinal sectional view showing an axial multi-piston type compressor according to the present invention.
Figure 2:
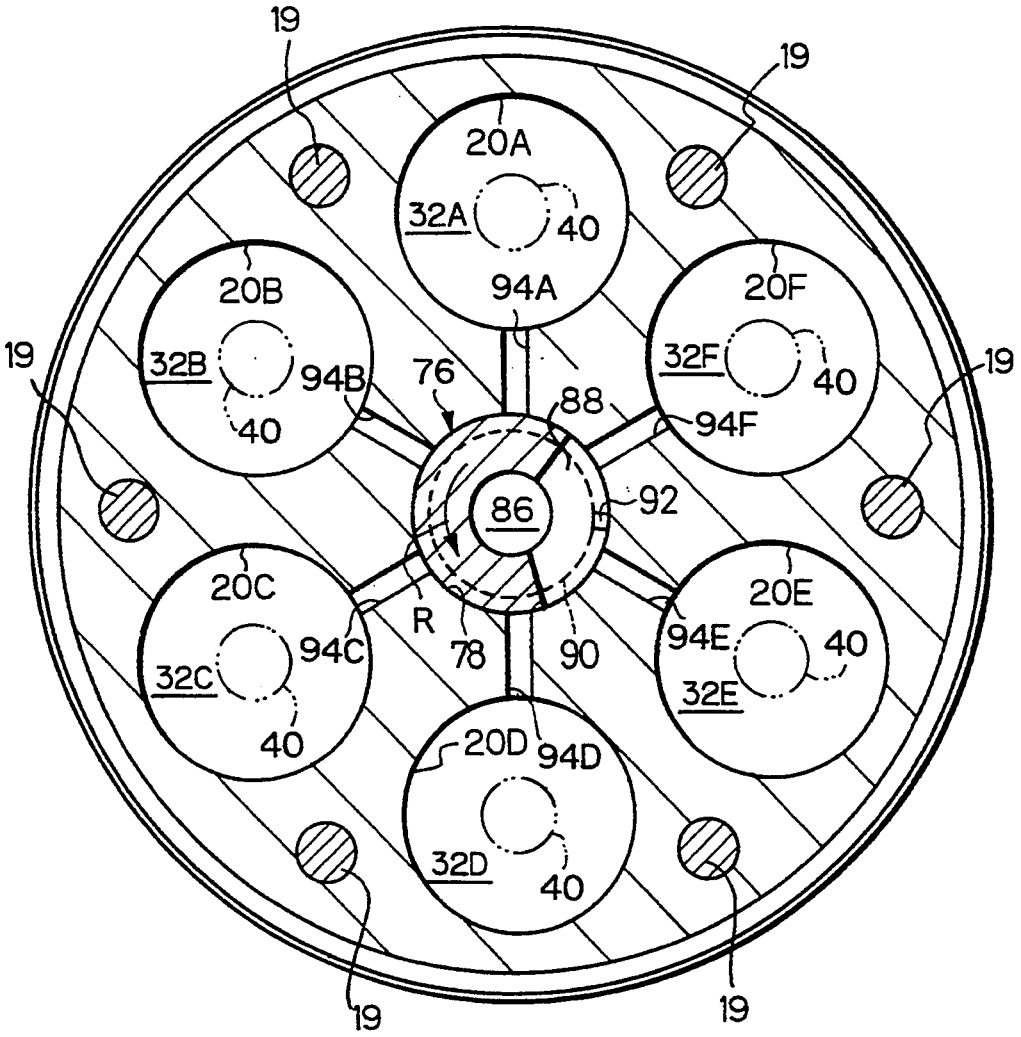
FIG. 2 is a cross-sectional view taken along a line II—II of FIG. 1.

FIG. 1 shows an axial multi-piston type compressor in which the present invention is embodied, and which may be used in an air-conditioning system (not shown) for a vehicle such as an automobile. The compressor comprises a cylinder block 10, front and rear housings 12 and 14 securely and hermetically joined to the cylinder block 10 at front and rear end faces thereof through the intermediary of O-ring rings 16 and 18, respectively. The cylinder block 10 and the housings 12 and 14 are assembled as an integrated unit by six screws 19 (see FIG. 2). In this embodiment, as shown in FIG. 2, the cylinder block 10 has six cylinder bores 20A, 20B, 20C, 20D, 20E, and 20F formed radially and circumferentially therein and spaced from each other at regular intervals, and each of the cylinder bores slidably receives a piston 22. The front housing 12 has a crank chamber 24 defined therewithin, and the rear housing 14 has a central suction chamber 26 and an annular discharge chamber 28 defined therewithin and partitioned by an annular wall portion **14*a* integrally projected from an inner wall of the rear housing 14. In this embodiment, the suction chamber 26 and the discharge chamber 28 are in communication with an evaporator and a condenser of the air-conditioning system, respectively, so that a fluid or refrigerant is supplied from the evaporator to the suction chamber 26 and a compressed refrigerant is delivered from the discharge chamber 28** to the condenser.

A valve plate assembly 30 is disposed between the rear end face of the cylinder block 10 and the rear housing 14, and defines compression chambers 32A, 32B, 32C, 32D, 32E, and 32F together with the heads of the pistons 22 slidably received in the cylinder bores 20A to 20F, as shown in FIG. 2. The valve plate assembly includes a disc-like plate member 34, a reed valve sheet 36 applied to an outer side surface of the disc-like plate member 34, and a retainer plate member 38 applied to an outer side surface of the reed valve sheet 36. The disc-like member 34 may be made of a suitable metal material such as steel, and has six discharge ports 40 formed radially and circumferentially therein and spaced from each other at regular intervals, so that each of the discharge ports 40 is encompassed within an end opening area of the corresponding one of the cylinder bores 20A to 20F. Note, in FIG. 2, each of the discharge ports 40 is illustrated by a phantom line. The reed valve sheet 36 may be made of spring steel, phosphor bronze, or the like, and has six discharge reed valve elements 42 formed integrally therewith and arranged radially and circumferentially to be in register with the discharge ports 40, respectively, whereby each of the discharge reed valve elements 42 can be moved so as to open and close the corresponding discharge port 40, due to a resilient property thereof. The retainer plate member 38 may be made of a suitable metal material such as steel, and is preferably coated with a thin rubber layer. The retainer plate member 38 has six retainer elements 44 formed integrally therewith and arranged radially and circumferentially to be in register with the discharge reed valve elements 42, respectively. Each of the retainer elements 44 provides a sloped bearing surface for the corresponding one of the discharge reed valve elements 42, so that each discharge reed valve element 42 is opened only by a given angle defined by the sloped bearing surface of the retainer element 44.

A drive shaft 46 extends within the front housing 12 so that a rotational axis thereof matches a longitudinal axis of the front housing 12, and one end of the drive shaft 46 is projected outside from an opening formed in a neck portion **12*a* of the front housing 12 and is operatively connected to a prime mover of the vehicle for rotation of the drive shaft 46. The drive shaft 46 is rotatably supported by a first radial bearing 48 provided in the opening of the neck portion 12*a* and by a second radial bearing 50 provided in a central passage formed in the cylinder block 10. A rotary seal unit 52 is provided in the opening of the neck portion 12*a* to seal the crank chamber 24** from the outside.

A drive plate member 54 is mounted on the drive shaft 46 so as to be rotated together therewith, and a thrust bearing 56 is disposed between the drive plate member 54 and an inner side wall portion of the front housing 12. Also, a sleeve member 58 is slidably mounted on the drive shaft 46, and has a pair of pin elements 60 projected diametrically therefrom. Note, in FIG. 1, only one pin element 60 is illustrated by a broken line. A swash plate member 62 is swingably supported by the pair of pin elements 60. As apparent from FIG. 1, the swash plate member 62 is in an annular form, and the drive shaft 46 extends through a central opening of the annular swash plate member 62. The drive plate member 54 is provided with an extension **54*a* having an elongated guide slot 54*b* formed therein, and the swash plate member 62 is provided with an integral bracket portion 62a projecting therefrom and having a guide pin element 62b received in the guide slot 54b, whereby the swash plate member 62 can be rotated together with the drive plate member 54, and is swingable about the pair of pin elements 60. A wobble plate member 64 is slidably mounted on an annular portion 66 projected integrally from the swash plate member 62, and a thrust bearing 68 is disposed between the swash plate member 62 and the wobble plate member 64**.

The sleeve member 58 is always resiliently pressed against the drive plate member 54 by a compressed coil spring 70 mounted on the drive shaft 46 and constrained between the sleeve member 58 and a ring element 72 securely fixed on the drive shaft 46, and thus the sleeve member 58 is resiliently biased against the drive plate member 54.

To reciprocate the pistons 22 in the cylinder bores 20A to 20F, respectively, the wobble plate member 64 is operatively connected to the pistons 22 through the intermediary of six connecting rods 74 having spherical shoe elements 74a and 74b formed at ends thereof, and the spherical shoe elements 74a and 74b of each connecting rod 74 are slidably received in spherical recesses formed in the wobble plate member 64 and the corresponding piston 22, respectively. With this arrangement, when the swash plate member 62 is rotated by the drive shaft 46, the wobble plate member 64 is nutated so that each of the pistons 22 are reciprocated in the corresponding cylinder bore 20A, 20B, 20C, 20D, 20E, 20F. The crank chamber 24 can be in communication with the suction chamber 26 and/or the discharge chamber through a suitable control valve (not shown) so that a pressure within the crank chamber 24 is variable, whereby the stroke length of the pistons 22 is adjustable.

As shown in FIGS. 1 and 2, according to the present invention, a rotary valve 76 is slidably disposed in a circular space 78 defined by a part of the central passage of the cylinder block 10. The rotary valve 76 is coupled to the inner end of the drive shaft 46 so as to be rotated together therewith. To this end, as shown in FIG. 1, the rotary valve 76 is provided with a central hole 80 having, for example, a square cross-section, and the drive shaft 46 is provided with a stub element 82 projected from the inner end face thereof and fitted in the central hole 80. Thus, the rotary valve 76 can be rotated together with the drive shaft 46. Note, in FIG. 1, a reference numeral 84 indicates a thrust bearing for the rotary valve 76, which is disposed in a central recess formed in the annular wall portion 14a of the rear housing 14.

Figure 3:
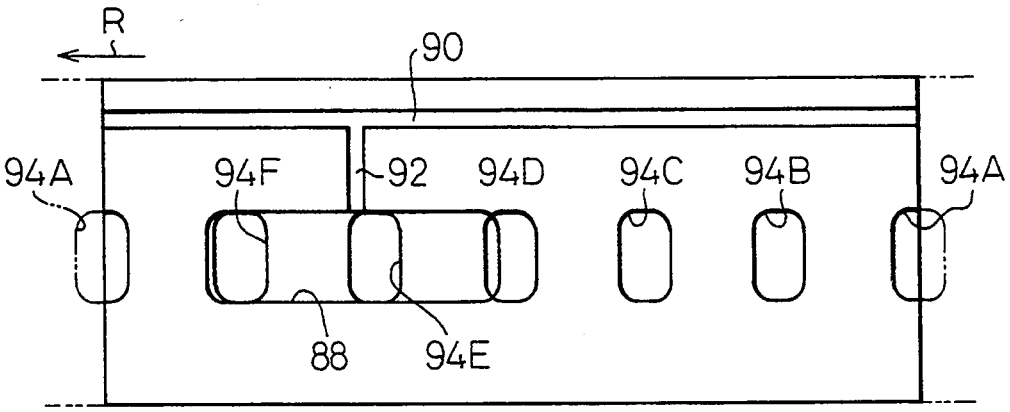
FIG. 3 is a development view showing an outer wall surface of a suction rotary valve and an inner wall surface of a central space formed in a cylinder block of the compressor and slidably receiving the suction rotary valve.

The rotary valve 76 is also provided with a central hole 86 formed therein, and the central hole 86 is opened at the other end face of the rotary valve 76 so as to be in communication with the suction chamber 26 through a central passage of the thrust bearing 84. As best shown in FIG. 2, a suction passage or sector-shaped groove 88 is formed in the rotary valve 76, and is in communication with the central hole 86. Thus, the sector-shaped groove 88 is in communication with the suction chamber 26 through the central hole 86. The rotary valve 76 is further provided with a closed circular groove passage 90 formed in a cylindrical peripheral surface thereof and disposed in the vicinity of the inner end thereof. As best shown in FIG. 3 in which an outer peripheral wall surface of the rotary valve 76 is shown as a development view, the circular groove passage 90 includes a groove section 92 extended therefrom and opened to the sector-shaped groove 88.

As best shown in FIG. 2, the cylinder block 10 is provided with six radial passages 94A, 94B, 94C, 94D, 94E, and 94F formed therein and extended from the compression chambers 32A to 32F to the circular space 78 of the cylinder block 10, respectively. In FIG. 3, an inner peripheral wall surface of the circular space 78 is also shown in a development view to illustrate a relationship between the rotary valve 76 and the arrangement of the radial passages 94A, 94B, 94C, 94D, 94E, and 94F.

When the rotary valve 76 is rotated by the drive shaft 46 in a direction indicated by an arrow R (FIGS. 2 and 3), the radial passages 94A to 94F successively communicate with the suction chamber 26 through the central hole 86 and the sector-shaped groove 88. Also, during the rotation of the drive shaft 46, the pistons 22 are reciprocated in the cylinder bores 20A to 20F, so that a suction stroke and a compression stroke are alternately executed in each of the cylinder bores 20A to 20F. During the suction stroke, i.e., during movement of the piston 22 concerned from top dead center toward bottom dead center, the refrigerant is introduced from the suction chamber 26 into the corresponding compression chamber 32A, 32B, 32C, 32D, 32E, 32F through the central hole 86, the sector-shaped groove 88, and the corresponding radial passage 94A, 94B, 94C, 94D, 94E, 94F. During the compression stroke, i.e., during a movement of the piston 22 concerned from bottom dead center toward top dead center, the refrigerant is compressed in the corresponding compression chamber 32A, 32B, 32C, 32D, 32E, 32F, and is then discharged therefrom into the discharge chamber 28 through the corresponding reed valve 42.

In FIG. 3, the compression chambers 32D, 32E, and 32F are subjected to the suction stroke. More particularly, the compression chamber 32D is shown just before the suction stroke is finished therein; the compression chamber 32E is shown in the middle of the suction stroke; and the compression chamber 32 is shown just after the suction stroke is initiated therein. Also, in FIG. 3, the compression chambers 32A, 32B, and 32C are subjected to the compression stroke. More particularly, the compression chamber 32A is shown just before the compression stroke is finished therein; the compression chamber 32B is shown in the middle of the compression stroke; and the compression chamber 32 is shown just after the compression stroke is initiated therein. In this situation, especially, a leakage of the compressed refrigerant is caused at the openings of the radial passages 94A and 94B of the compression chambers 32A and 32B in which a pressure of the refrigerant is made to be higher due to the compression stroke, and prevails in a clearance between the outer surface of the rotary valve 76 and the inner surface of the circular space 78. Nevertheless, the leakage of refrigerant that prevails in the clearance can be prevented from being introduced into the crank chamber 24, due to the existence of the circular groove passage 90 formed in the cylindrical peripheral surface thereof. Namely, the part of the leakage of refrigerant that is moved toward the crank chamber 24 is recovered by the circular groove passage 90, and is then introduced into the sector-shaped groove 88 through the groove section 92. Accordingly, during the operation of the compressor, the pressure within the crank chamber 24 is not uncontrollably raised, and thus an adjustment of a stroke length of the pistons 22 can be properly made.

It should be understood that the present invention is preferably embodied in axial multi-piston type compressors disclosed in U.S. Pat. Nos. 5,232,349, and the copending U.S. application Ser. No. 131,449, 132,116, 131,452, and 131,453.

Figure 4:
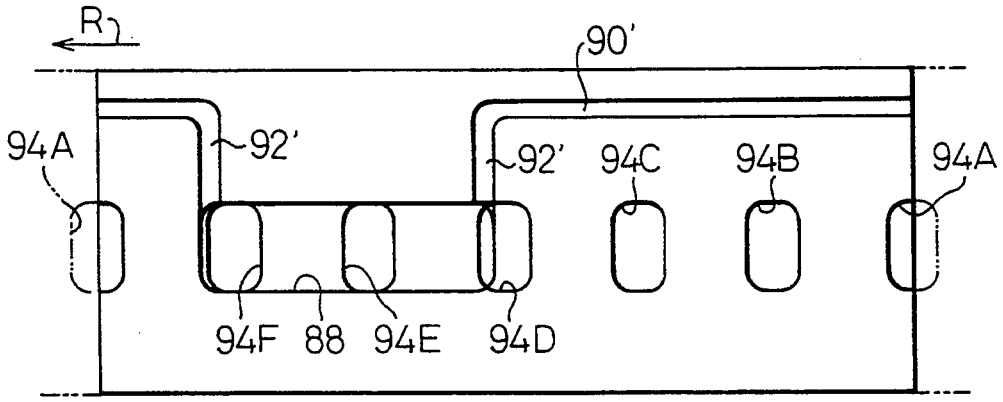
FIG. 4 is a development view similar to FIG. 3, showing a modification of the embodiment shown in FIGS. 1 to 3.

FIG. 4 shows a modification of the embodiment shown in FIGS. 1 to 3. In this modified embodiment, a circular groove passage 90' is not fully extended around the cylindrical peripheral surface of the suction rotary valve 76. Namely, the circular groove passage 90' is extended from one end of an elongated opening of the sector-shaped groove 88 to the other end thereof, both ends of the circular groove passage 90' are in communication with the sector-shaped groove 88 through groove sections 92' formed in the outer surface of the rotary valve 76 and extended from the ends of the elongated opening of the sector-shaped groove 88. With this arrangement, the circular groove passage 90' is cooperated with the sector-shaped groove 88 and the groove sections 92' to form a closed loop around the cylindrical peripheral surface of the suction rotary valve 76. Accordingly, the leakage of the compressed refrigerant that is caused at the openings of the radial passages the compression chambers subjected to the compression stroke and prevails in the clearance between the outer surface of the rotary valve 76 and the inner surface of the circular space 78, can be prevented from being introduced into the crank chamber 24, due to the existence of the closed loop formed by the circular groove passage 90', the sector-shaped groove 88, and the groove sections 92'.

Finally, it will be understood by those skilled in the art that the foregoing description is of a preferred embodiment of the disclosed compressor, and that various changes and modifications may be made to the present invention without departing from the spirit and scope thereof.

We claim:

1. An axial multi-piston type compressor comprising:

a drive shaft;

a cylinder block having cylinder bores formed therein and surrounding said drive shaft, a central circular space formed therein, and respective radial passages formed therein for communicating said cylinder bores with said central circular space;

a plurality of pistons slidably received in the respective cylinder bores;

a housing member associated with said cylinder block to define a crank chamber therebetween;

a conversion means placed in said crank chamber for converting a rotational movement of said drive shaft into a reciprocation of each piston in the corresponding cylinder bore such that a suction stroke and a discharge stroke are alternately executed therein; and a suction rotary valve means rotationally and slidably received in the central circular space of said cylinder block to cooperate with the radial passages of said cylinder block for successively introducing a fluid into the cylinder bores subjected to the suction stroke, through the corresponding radial passages thereof, and for successively closing the radial passages of the cylinder bores subjected to the compression stroke, a leakage of a compressed fluid being caused at openings of the radial passages of the cylinder bores subjected to the compression stroke, and prevailing in a clearance between an outer surface of said suction rotary valve means and an inner surface of the central circular space of said cylinder block, wherein said suction rotary valve means including a circular groove passage means formed in the outer surface thereof for recovering the leakage of the compressed fluid so as to prevent introduction of the leakage of the compressed fluid into said crank chamber.

2. An axial multi-piston compressor as set forth in claim 1, wherein said suction rotary valve means includes a sector-shaped groove formed therein and supplied with a fluid to be compressed, and said sector-shaped groove is arranged so as to be successively communicated with the radial passages of the cylinder bores subjected to the suction stroke, said circular groove passage means being disposed at a peripheral zone of said suction rotary valve between said crank chamber and said sector-shaped groove.

3. An axial multi-piston compressor as set forth in claim 2, wherein said circular groove passage means forms a closed loop around the outer surface of said suction rotary valve means, and is in communication with said sector-shaped groove through a groove section formed in the outer surface of said suction rotary valve means and extended therebetween.

4. An axial multi-piston compressor as set forth in claim 2, wherein said circular groove passage means cooperates and communicates with said sector-shaped groove to form a closed loop around the outer surface of said suction rotary valve means.

* * * * *